US010134246B2

(12) United States Patent
Schoettle et al.

(10) Patent No.: US 10,134,246 B2
(45) Date of Patent: Nov. 20, 2018

(54) SIGNALING DEVICE WITH LIGHT MODULE

(71) Applicant: WERMA Holding GmbH + Co. KG, Rietheim-Weitheim (DE)

(72) Inventors: Timo Schoettle, Renquishausen (DE); Ronny Lauer, Donaueschingen (DE)

(73) Assignee: WERMA HOLDING GMBH + CO. .KG, Rietheim-Weilheim (DE)

( * ) Notice: Subject to any disclaimer, the term of this patent is extended or adjusted under 35 U.S.C. 154(b) by 0 days.

(21) Appl. No.: 15/359,565

(22) Filed: Nov. 22, 2016

(65) Prior Publication Data

US 2017/0148283 A1 May 25, 2017

(30) Foreign Application Priority Data

Nov. 24, 2015 (DE) ..... 10 2015 120 280

(51) Int. Cl.

| | |
|---|---|
| ***G08B 7/06*** | (2006.01) |
| ***F21V 23/06*** | (2006.01) |
| ***F21V 23/00*** | (2015.01) |
| ***F21V 19/00*** | (2006.01) |
| *F21Y 115/10* | (2016.01) |

(52) U.S. Cl.

CPC ..... *G08B 7/06* (2013.01); *F21V 19/003* (2013.01); *F21V 23/001* (2013.01); *F21V 23/06* (2013.01); *F21Y 2115/10* (2016.08)

(58) Field of Classification Search

CPC ..... G08B 7/06; F21V 19/003; F21V 23/001; F21V 23/004; F21V 23/005; F21V 23/06; F21Y 2115/10

(Continued)

(56) References Cited

U.S. PATENT DOCUMENTS 6,382,811 B1 * 5/2002 Bernard ..... F21S 8/00 362/236
8,057,263 B1 * 11/2011 Howard ..... H01R 12/721 439/631

(Continued)

FOREIGN PATENT DOCUMENTS

DE 10041 202 A1 3/2002
DE 198 54 666 C2 1/2003

(Continued)

*Primary Examiner* — Brian Wilson
(74) *Attorney, Agent, or Firm* — Breneman & Georges

(57) ABSTRACT

An optical signaling device, in particular a signal pillar (1) of modular construction or similar with at least one first exchangeable light module (3) comprising at least one light element (10) is proposed for optical indication of one or more different operating states of a technical device (2) such as a machine, a plant, a vehicle or similar, wherein the first light module (3) comprises at least one first circuit board (11) oriented essentially in direction of a longitudinal axis (8) of the signaling device with the at least one first light element (10) and electrical components, wherein at least one contact (32) is provided between at least one first detachably contactable electrical contact surface (19) and a second electrical contact surface (18) of an adjacently arranged module (3, 4, 5, 6, 7) configured as a second light module (3) and/or as a holding module (5) and/or as a base module (6) for holding and connecting the signaling device at an operating position, wherein the adjacently arranged module (3, 4, 5, 6, 7) comprises at least one second circuit board (11) oriented essentially in direction of the longitudinal axis (8), which meets stringent requirements as regards the contacting between two adjacent modules and at the same time the constructional expenditure and/or realizes an improved energy/power supply of the modules. According to the invention this is achieved in that at least the two electrical contact surfaces (18, 19) of the contact (32), which can be (Continued)

Figure 1:
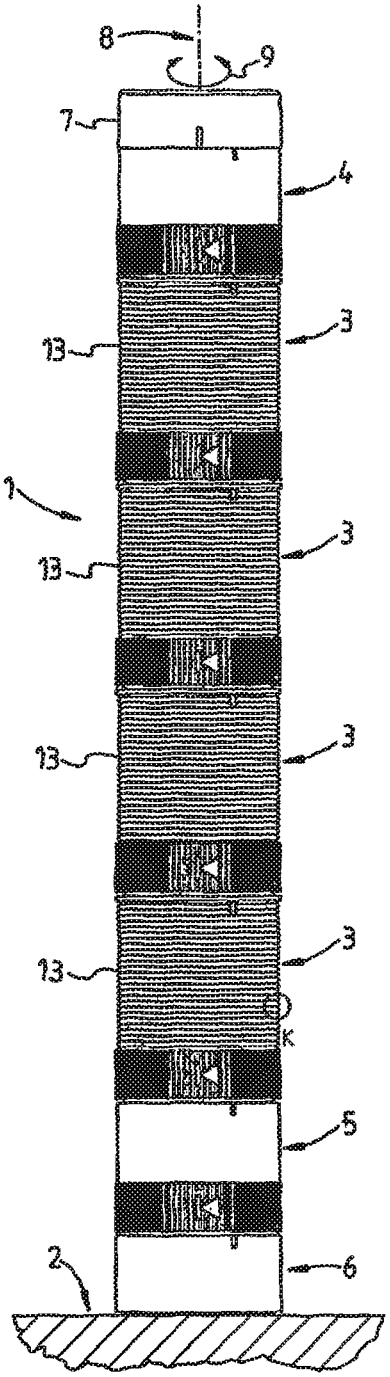

detachably contacted with each other, are arranged between the first circuit board (11) and the second circuit board (11) in direction of the longitudinal axis (8).

7 Claims, 6 Drawing Sheets

(58) Field of Classification Search
USPC ..... 340/908, 908.1, 691.1, 691.4, 691.8, 340/815.4–815.9; 361/728, 729, 731, 361/735, 736, 785, 790, 792, 803
See application file for complete search history.

(56) References Cited

U.S. PATENT DOCUMENTS

2006/0262533 A1 11/2006 Lin
2008/0242408 A1* 10/2008 Hwang ..... G07F 17/3202 463/31
2010/0053956 A1 3/2010 Park
2015/0049485 A1 2/2015 Kamitani
2015/0198317 A1* 7/2015 Feller ..... H05B 33/0842 362/249.01
2015/0201261 A1* 7/2015 Feller ..... H04R 1/028 381/395

FOREIGN PATENT DOCUMENTS

EP 1 347 233 A2 9/2003
EP 1 467 140 B1 7/2007
EP 3 043 111 A1 7/2016
JP 50-028246 4/1975
JP 63-049269 4/1988
JP 3-006675 1/1995
JP 11-249607 9/1999
JP 2004-252374 9/2004

* cited by examiner

SIGNALING DEVICE WITH LIGHT MODULE

The invention relates to an optical signaling device, in particular a signal pillar of modular construction or similar, with at least one first exchangeable light module comprising at least one light element for optical indication of one or more different operating states of a technical device such as a machine, a plant, a vehicle or similar, according to the preamble of claim 1.

PRIOR ART

Optical signaling devices or signal pillars of this kind have been in use for years in a most diverse variety of variants. A commonly used form is the "classic" signal pillar with three replaceable interchangeable modules, which usually comprise the colors red, yellow and green. Since signal pillars are mostly of modular construction, it is quite possible to include additional interchangeable modules in the colors blue or white etc. or to again remove individual interchangeable modules if operating conditions or applications change. Frequently acoustic signal generators such as piezo disks or multi-tone generators or horns etc. are also integrated in the device, thus catering for both optical and acoustic signaling.

With modularly constructed optical signal devices there exist, on the one hand, the so-called "preconfigured" devices, where construction of the firmly mutually connected modules is pre-defined and unalterable, for example in the colors red, yellow green.

Also in widespread use are the temporarily mutually connectable interchangeable modules, which can be detached without the use of tools, in so-called "non-preconfigured" devices/signal pillars. Here, individual modules, in particular light modules and/or acoustic modules, can be randomly combined with each other and exchanged or replaced without the use of tools at a later time. This approach offers particularly high flexibility as regards applicability when using standardized interchangeable modules. For example a "blue" stage or interchangeable module may be subsequently added and/or a damaged/broken light module/interchangeable module can be replaced by a new intact light module/interchangeable module without a great deal of expenditure.

This is of great advantage, in particular with modern light modules with long-life LEDs or circuit boards/printed circuit boards, since compared to the incandescent bulbs frequently used in the past, not only the illuminant, that is to say the incandescent bulb, but in case of damage or destruction of the illuminants and/or the circuit boards, the entire interchangeable module/light module is replaced, repair nowadays being no longer a viable option mostly for economic reasons.

In particular in the case of modularly constructed signal pillars with interchangeable modules, for many years the power/energy supply of individual modules has commonly been accomplished with the aid of wires using "loop-through". As such, according to DE 100 41 202 A1, for example, a signal pillar with up to five stages/light modules is described, wherein apart from the five separate energy supply/power cables/wires a minus pole/neutral conductor/wire is additionally present in each module, which is "looped-through" from stage to stage. This means that up to now normally each interchangeable module/light module respectively comprises six wires on the inside of the calotte, so that all interchangeable modules of a max. five-stage signal pillar are configured identically and can be exchanged with one another at random. Signaling of the respective module, e.g. of stage no. 3, is effected in that a closed and energized circuit of wire no. 3 is realized using the neutral conductor.

As such each interchangeable module light module must respectively comprise six contact points, with which the electrical connection can be "looped-through" from a first module to an adjacent module. This means that both face sides of the interchangeable modules each comprise a total of six separable contact points, so that when a module/an interchangeable module is disassembled, all six contact points are undone/separated. When assembling/fixing two interchangeable modules/light modules together, the contact points are again connected, i.e. a wire/a contact surface of the first module is connected together with the corresponding second wire/a second contact surface of the adjacently arranged module.

In particular in the case of signal pillars with interchangeable modules these contact points/this contacting must meet stringent requirements when carrying out replacements, i.e. during assembly and/or disassembly of one of the modules/interchangeable modules. As such signal pillars, during their lifetime, experience to some extent very frequent exchange of such modules/interchangeable modules, wherein reliable contacting and thus a reliable energy supply between the modules which can be exchanged without tools must be ensured under all circumstances.

EP 1 467 140 B1 has revealed a signal pillar, wherein a circuit board/printed circuit board is used which is aligned in longitudinal direction of the signal pillar. During operation/when in use the circuit board is permanently in contact with wires. These wires extend radially outwards towards the inside of the calotte, wherein the contact points to be separated during disassembly of the respective module are realized between two adjacent/between two detachably connectable interchangeable modules/modules, again on the inside of the calotte. Therefore in this case too, the contacting between individual interchangeable modules/light modules which has been in use for years is realized with wires. Here "loop-through" of the energy supply between individual interchangeable modules corresponds to the previously common signal pillars with "wire loop-through" according to DE 100 41 202 A1.

Furthermore DE 198 54 666 C2 has disclosed a number of signal pillar variants with detachably fixable interchangeable modules. With one of these variants the interchangeable modules/light modules each comprise planar circuit boards/printed circuit boards, which are arranged in direction of the longitudinal axis of the signal pillar. As such these circuit boards are equipped with plugs and sockets, wherein contacting of two adjacent light modules/interchangeable modules can be realized exclusively by a joining/moving procedure oriented in direction of the longitudinal axis. The pin-like plugs and the sockets shall ensure reliable contacting of the contact points between two separable interchangeable modules/light modules.

The plugs/the sockets are arranged here on the printed circuit board and are thus attached in a staggered fashion to the printed circuit board. Moreover the plug contact is realized by means of pins and spring-elastic sockets, in order to realize a press-on force between plug and socket, which shall ensure reliable electrical connection/contacting during operation.

Object and Advantages of the Invention

It is therefore the object of the invention to propose an optical signaling device of the kind mentioned in the beginning, which meets stringent requirements regarding the contacting between two adjacent modules and at the same time realizes the constructional expenditure and/or an improved energy/power supply of the modules.

Based on an optical signaling device of the kind mentioned in the beginning this object is met by the characteristics of claim 1. Due to the measures cited in the sub-claims advantageous realizations and further developments of the invention are possible.

Accordingly an optical signaling device according to the invention is characterized in that at least the two electrical contact surfaces of the contact, which can be detachably contacted with each other, are arranged/provided (preferably flush) between the first circuit board and the second circuit board in direction of the longitudinal axis, preferably on/in (an extension) of a plane of at least one of the circuit boards and/or on/in a longitudinal center plane of the light module/module.

Using this measure has the effect that almost no torques are generated during connecting/contacting of two adjacent modules/interchangeable modules/light modules. This reduces, among others, the risk that during operation or during repeated exchanging/replacing of individual modules/light modules or detaching and re-connecting of adjacent modules/light modules, a disadvantageous load on, or impairment of, the contact or contact point can occur due to a torque effect of eccentrically mounted contacts/contact surfaces. As such, the pin-like plug and the associated socket according to DE 198 54 666 C2, for example, can experience a mechanical force impact due to a torque load occurring during the plug-in operation while axially connecting/interlocking adjacent modules/interchangeable modules, and during repeated assembly/disassembly it is possible for the plug and/or the soldered connections between plug/socket and the circuit board to be damaged and thus for the energy/power supply to be impaired between individual modules/interchangeable modules.

By contrast, according to the present invention, a comparatively large force impact can be realized between the first and the second contact surface of the contact, i.e. between two detachably connectable adjacent modules, preferably in direction of the longitudinal axis in a plane of at least one of the circuit boards and/or on/in a longitudinal center plane of the light module/module between the two respective circuit boards. This will ensure reliable/secure contacting or electrical energy supply/power supply between adjacent modules/interchangeable modules. Moreover any possibly occurring assembly or manufacturing tolerances of individual contacting elements can be compensated for in an advantageous manner.

In addition comparatively large-sized and repeatedly bent-over contact wires, as has been common with previous standard signal pillars, may be omitted or improved upon with the aid of the present invention. This will reduce not only constructional expenditure but also economic expenditure in an advantageous manner compared to the state of the art. For example repeated bending-over of the respective contact wire, as described e.g. in DE 100 41 202 A1, can be omitted or reduced. In contrast to the present invention corresponding assembly or fixing of repeatedly bent-over energy supply wires according to the state of the art is also comparatively expensive and thus disadvantageous from an economic point of view.

Preferably the first contact surface and the second contact surface of the contact are preferably arranged on/in (an extension) of a plane of at least one of the circuit boards and/or on/in a (common) longitudinal center plane of the light module/module, (preferably flush) between the face side of the first circuit board and the face side of the second circuit board. Thus a direct flow of force/force-lock or an advantageous force effect can be absorbed/realized in a particularly advantageous manner in longitudinal direction of the circuit board(s). Thus comparatively large forces, i.e. contact/press-on forces can be realized for contacting, which can be absorbed by at least one of the circuit boards and/or both circuit boards in an advantageous manner, without considerable/disadvantageous torques or mechanical stresses being generated on the circuit board or the contact.

With one advantageous embodiment of the invention at least one second contact is provided in direction of the longitudinal axis, preferably arranged on/in (an extension) of a plane of at least one of the circuit boards and/or on/in a longitudinal center plane of the light module/module, (preferably flush) between the first circuit board and a third circuit board, for electrically connecting and contacting the first light module with an adjacently arranged third light module or with the holding element and/or the base module, wherein the second contact (like the first contact in terms of the invention) comprises at least one first contact surface and one second electrical second contact surface detachably connectable with the first contact surface. This means that the second contact is provided for detachably connecting the first light module with a further or a third module/light module/interchangeable module, and preferably the respective two so-called "first" and "second" contact surfaces and/or are configured so as to be almost identical/similar from a constructional point of view.

Preferably the first contact is arranged on a first base surface/a first face side of the light module/module and the second contact is arranged on a second base surface/face side of the light module/module opposite the first. This has the effect of achieving in an advantageous manner that one module/interchangeable module or light module is arranged/can be integrated between a further or the third light module and another/the second light module or the holding element or the base module. Thus a signaling device or a signal pillar can be realized which comprises a number of light modules and/or base/holding modules.

Preferably the second contact is configured so as to be identical/the same and/or constructionally almost identical/similar to the first contact. In this way modularity/exchangeability of individual modules of the optical signaling device/the signal pillar is further improved. In this way in an advantageous manner a transfer or "loop-through" of the energy or power supply from one module to a further module and from this module to a further/third module etc. can be advantageously realized.

Generally speaking this allows for an advantageous flow of force or force progression through an entire optical signaling device or an entire signal pillar via the respective circuit boards and the contacts respectively arranged in between, in longitudinal direction. A disadvantageous torque impact due to respective eccentric contact points as in the state of the art can be avoided according to the invention. Thus thinner wall thicknesses for the calottes or base surfaces and/or for fixing the circuit boards to the calottes/base surfaces may potentially be realized, which has an advantageous constructional and economic effect.

Preferably the contact surfaces are aligned transversely or essentially vertically/orthogonally to the longitudinal axis. This will allow an advantageous press-on force/contacting to be ensured between two adjacent modules. It is thus possible to realize high contact forces/press-on forces which ensures high safety during "loop-through" of the electric energy supply between the modules or between each two modules and from one module to a further module.

With one advantageous embodiment of the invention the first contact surface and the second contact surface of the contact between two adjacent modules is arranged so as to be flush between the circuit boards/the respective circuit boards of adjacent modules. This again allows an advantageous flow of force between detachably exchangeable, adjacent modules/circuit boards in the operating state, i.e. for adjacent modules detachably fixed together. Accordingly an advantageous flow of force is again achieved without relevant torque generation, when in operation.

With a particular further development of the invention the first and/or second face side of the first and/or second circuit board is configured at least partially as one of the contact surfaces. This means that the first and/or the second circuit board is a part of/is one side of the inventive electric contact to be established, or that this circuit board can be used directly for the contacting of two adjacent modules/interchangeable modules/light modules. It is thus possible to omit separate contact elements for the connection between this circuit board/the illuminant and the detachable contact of the modules/light modules, which considerably reduces the constructional and economic expenditure for the manufacture of the inventive module/light module/interchangeable module. Thus separate, repeatedly bent electrical contact wires, as in the state of the art, can be omitted at least partially/for the electrical connection of one of the circuit boards.

As such it is perfectly possible for the first face side of the first circuit board to be electro-conductively connected directly, e.g. by means of advantageous soldered contacts, to the second face side of the second circuit board. This means that the contact according to the invention between two adjacent modules, in particular light modules, is realized exclusively by two adjacently arranged, longitudinally aligned circuit boards when in operation. With this constructionally very low-cost contact point or contacting of adjacent modules/interchangeable modules/light modules, construction-related expense/the number of required/used components is reduced to a minimum.

One point to be taken into account, however, consists in that potentially somewhat larger manufacturing tolerances/tolerances in forming the face-side contacts or face-side contact surfaces, in particular the solder joints, may possibly, to a certain extent, lead to negative impacts on the electric connection/the electric "loop-through" of the (entire) energy/power supply between adjacent modules/interchangeable modules. A certain amount of reworking, such as subsequent grinding work or adaptation/adjustment of the dimensions of individual face contacts/solder joints or contact surfaces, may however be of advantage here, so that spatial tolerances, in particular of the solder joints, are equalized and arrangement/alignment of all contact surfaces of the face side on a common plane is ensured.

Preferably at least three first and/or second contact surfaces are arranged along one face side of the first and/or second circuit board and/or along a straight oriented transversely to the longitudinal axis, wherein the circuit board and/or the straight is arranged on a longitudinal center plane oriented in direction of the longitudinal axis of the first light module and/or the module. Using this arrangement it may be possible to achieve that the contact surfaces/at least three, in particular a number of first and/or second contact surfaces arranged transversely to the longitudinal axis (adjacently, in particular spaced-apart) of at least three, in particular a number of contacts, and/or preferably the circuit board is arranged essentially centrally/in the center or in the longitudinal center plane of the light module/module.

Advantageously the longitudinal center plane/the circuit board divides the module/the calotte into two halves, preferably into two similar circular segments/circular halves. In most cases cylindrical modules/interchangeable modules/light modules or hollow-cylindrical calottes are provided.

In principle the longitudinal center plane in terms of the invention is defined/configured such that the longitudinal center plane includes the longitudinal axis, which extends through the middle/the center of the center/spatial center of gravity of the cross-section of the module/interchangeable module/light module. With a cylindrical module the longitudinal center plane, as a flat surface, therefore divides the circular cross-section symmetrically into two semicircles and in addition includes the centrally arranged longitudinal axis. The circuit board may extend across the entire cross-section or only over part thereof, i.e. if it is narrower than the (clear) cross-section of the module/light module/interchangeable module, in particular in the area of the longitudinal center plane.

Advantageously a number of contacts/contact surfaces are arranged (adjacently, in particular spaced apart) correspondingly transversely to the longitudinal axis and at the same time on one side or respectively on two opposing sides of the longitudinal center plane in direction of the longitudinal axis, i.e. preferably on the straight. In other words, a number of contacts are arranged transversely, in particular vertically/orthogonally to the longitudinal axis, preferably along a straight line/the straight. This allows a substantially symmetrical configuration of the contacts, in particular a number of contact surfaces, to be achieved. For example, if a bayonet closure is used for establishing the detachable module connection, i.e. in particular for light modules with bayonet closure for detachably connectable fixing of adjacent light modules/interchangeable modules/modules, such an arrangement of the inventive contact surfaces or contacts on the longitudinal center plane and/or with a symmetrical arrangement on the cross-sectional surface is of particular advantage.

With an advantageous variant of the invention at least one of the first and/or second circuit boards comprises at least two electrical interconnecting lines, so that at least two contacts oppositely arranged in direction of the longitudinal axis of this circuit board, in particular two "first" contacts with two "second" contacts according to the invention, can be electro-conductively connected. In this way the circuit board can be advantageously configured as an interconnecting line. Accordingly the energy/power supply can be run through or "looped-through" as it's called, from a first light module/interchangeable module/module via the light module/interchangeable module/module of this circuit board or via this second light module/interchangeable module/module as far as a third module/interchangeable module/light module.

Accordingly separate, additional interconnecting wires such as used in the art, which are usually arranged on the inside of the calotte, may be advantageously omitted when using this variant of the invention. Constructional and also economic expenditure for the manufacture and realization of respective modules/light modules is thus reduced.

Preferably provision is made for six electrical interconnecting lines, including the circuit board. A signal pillar/an optical signaling device with a total of five optical/acoustic modules can thus be realized in an advantageous manner. Moreover it is feasible that based on high quality standards/based on the miniaturization with regard to electric circuit boards/electronic components on a circuit board of the optical signaling device or a light module/interchangeable module/module according to the invention, even more than six electrical interconnecting lines may be present, in particular if using multi-layer circuit boards, so that in contrast to the state of the art not just five electric modules/interchangeable modules/light modules, but possibly up to 10 or even more light modules/interchangeable modules/modules with optical and/or acoustic electronic components/signaling components may be used.

Advantageously the light module/interchangeable module/module comprises at least one contact element with the second electric contact surface of the contact. Preferably this contact element is connected or electrically contacted with the second electric contact surface of the contact with a face side of the circuit board/the adjacently arranged circuit board of an adjacently arranged light module/interchangeable module/module. That is to say, in operating position the contact element with the second electric contact surface in this preferred variant is in direct contact or touch with a face side or contact surface of the adjacent circuit board.

An advantageous contact element with the second electric contact surface of the contact may be used to compensate for manufacturing or assembly tolerances and/or further advantageous functions. As such manufacture of a face-side contact of the circuit board, realized e.g. as a soldered joint, is comparatively inflexible as regards compensation of assembly or manufacturing tolerances. Admittedly at the face side of the circuit board it is advantageously possible/without a great deal of expenditure, to apply soldering tin or metallic material, but these soldered joints etc. may potentially have comparatively disadvantageous manufacturing tolerances. In these cases adjacently arranged second contact surfaces could conceivably have the effect that e.g. one of the contacts between two adjacently arranged modules/interchangeable modules can only under certain circumstances, ensure a sufficient electric transit of the energy supply or power supply between adjacent modules. In order to reliably avoid such feasible disadvantages during "loop through" of the energy/power supply, post-treatment such as grinding-down of the face-side or soldered joints or similar and/or the use of the advantageous contact element with the second electric contact surface of the contact is of particular advantage. For example the contact element, at least in direction of the longitudinal axis, is configured to be resilient or flexible or adjustable/movable.

Preferably the contact element is configured as a contact spring, which is adjustable at least partially lengthwise in direction of the longitudinal axis and/or essentially vertically in direction of the longitudinal axis, in order to generate a press-on force effective in direction of and/or transversely to the longitudinal axis. In this way manufacturing tolerances in respect of circuit boards or adjacent modules and/or of a number of contacts can be compensated for in an advantageous manner. Moreover advantageous contact/press-on forces can be realized so that reliable electric contacting/forwarding of the electric energy supply between the modules/light modules is realized.

In one advantageous embodiment of the invention a housing element of the module and/or the first light module is configured as a fixing unit for fixing the contact element(s) and/or the circuit board. For example, the housing element is configured as a calotte of a light module. Preferably the housing element is permeable or transparent to visible light, in particular in the area of a cylindrical surface of a cylindrical module/light module.

Preferably fixing of the circuit board is provided on the cylindrical surface element of the module/light module. Alternatively or in combination therewith the circuit board and/or the contact element may be (additionally) fixed to a base surface element of the module/light module or to a housing element of the module/light module, which is arranged or present on the face side.

The fixing or the fixing unit for fixing the one or more contact elements or the first and/or second contact surface of the contact may be advantageously realized to the housing element or base surface element arranged on or present on the face side, i.e. in the area of a base surface of the module/light module/interchangeable module.

For example the fixing unit may be configured as a locking unit, so that the circuit board and/or the one or more contact elements can be fixed/locked onto the housing element, in particular on the base surface of the housing element or the face-side of the housing element. With such a fixing or locking arrangement it is of advantage that during manufacture of the module/light module/interchangeable module the circuit board and/or the one or more contact elements are connected with the housing element by attaching them/pressing them in and are thus as reliably fixed as possible for the entire duration of use or operation. It may also be possible, under certain circumstances, if the circuit board or the contact element are impaired in some way, to again undo (using a tool) the locking arrangement of the circuit board and/or the contact element. From an economic point of view this is however not an advantage, so that one should really work on the premise that in case of an impairment of a circuit board or the electronic components on it, the entire respective module is replaced as a whole instead of renewing individual parts.

Preferably a face side of the housing element/a base surface of the housing element comprises a light-impermeable material and/or a light-impermeable blind element or covering element and/or layer, so that the light of the module/light module/interchangeable module cannot/should not be transferred to an adjacent module/light module/interchangeable module. It is thus possible to realize a clear light pattern of an individual module/light module without the possibility of adjacent light modules/modules being optically mixed with each other.

Preferably the contact element comprises a barb or similar with which an electric contacting with the circuit board is realized. This permanent contacting between the contact element and the circuit board advantageously permits an advantageous energy/power supply of the circuit board on the one hand and a transfer or loop-through to an adjacent module on the other.

Preferably the circuit board comprises a contact area, which is aligned in longitudinal direction of the signal pillar/the optical signaling device/module and/or essentially in parallel to the longitudinal center plane. This means that the contact area of the circuit board for contacting the contact element is realized, not by means of the face side, but with the almost planar surface of the circuit board. That means that this as permanent as possible a contacting of the circuit board with the contact element, which exists within the module/light module/interchangeable module is realized on the longitudinal surface oriented preferably vertically to the face side of the circuit board and comprising the electric and/or electronic components.

However, it is also possible to arrange for as permanent as possible a contacting inside the module/light module/interchangeable module with the contact element according to the invention on the face side of the circuit board. This means that with this embodiment the contact element is arranged between the two opposite faces of the first and the second circuit boards, wherein however one contacting is permanent and the other contacting according to the invention between the modules/light modules is detachably connectable in terms of the invention, i.e. comprises the inventive contact with the first and second contact surfaces.

Generally the as permanent as possible a contacting of the contact element/the circuit board existing inside the module/light module is permanently connected both with the assembled module and with the disassembled adjacent module during operation, i.e. in other words, the contacting is (preferably) not/never undone. The connection/contacting between the contact element of the first module and the circuit board of the first module may certainly be a detachable electrical connection, such as a spring-loaded contacting. However, this contacting is realized during manufacture of the respective module/light module and is not undone in operation or when replacing a light module/interchangeable module. By contrast, the contact according to the invention, i.e. with the inventive first and the second contact surface, is connected between two adjacent modules during operation and is undone again as required, i.e. during replacement or disassembling of a module/light module according to the invention.

For example the electrical connection/the contact according to the invention is ensured with the aid of a longitudinal adjustment/a press-on force in longitudinal direction. Alternatively or in combination therewith, a sliding contact may be advantageously configured as a contact according to the invention by means of the transverse adjustment/bayonet closure of two adjacent modules. A sliding contact, in particular an elastic sliding contact in longitudinal direction, ensures high reliability as regards electrical transfer of the energy/power supply from one module/light module to an adjacent module/light module.

With a preferred further development of the invention the contact or sliding contact comprises, at least partially, a relative adjustability of the two contact surfaces according to the invention, wherein the adjustment path is oriented transversely/vertically and/or rotationally relative to the longitudinal axis. Advantageously an additional adjustment or adjustment path in direction of the longitudinal axis for generating a press-on force or spring force is beneficial. This is realized in particular with a bayonet closure or similar in an advantageous manner. With this arrangement, as well as a longitudinal adjustment, an additional rotatory adjustment is generated when connecting two adjacent modules/light modules.

As such, when joining two adjacent modules a first adjustment path may be oriented in longitudinal direction of the longitudinal axis and in a subsequent step a second adjustment path may be provided in transverse direction and/or radial direction, i.e. rotationally about the longitudinal axis. It has become evident that such a transverse adjustment, in particular a bayonet connection between two adjacent modules/light modules/interchangeable modules is of particular advantage. With a bayonet connection of this kind contacting of adjacent modules/light modules/interchangeable modules is effected inter alia in that the two contact surfaces can be pressed together or adjusted in longitudinal direction and subsequently are adjusted/rotated in an advantageous manner essentially parallel to one of the contact surfaces or both contact surfaces of the contact according to the invention. A rotation about e.g. approx. 10°, 20° or 30° etc. may be envisaged.

With a particular variant of the invention the contact element is configured as a fixing element for fixing the circuit board to the housing element of the module/light module. For example, the contact element is configured as a contact spring for fixing to the circuit board, wherein fixing to the circuit board on the one hand and/or fixing to the housing element/module/light module on the other hand can be realized with the aid of an elastic force or advantageous fixing elements such as snap-in hooks, fixing lips, clamping elements, barbs or similar. With the aid of an arrangement of the contact element between housing element and circuit board, the contact element can be given an advantageous dual/multiple function, i.e. on the one hand for establishing contact with the adjacent module, and on the other, for fixing the circuit board to the respective module/light module and/or for fixing it to the circuit board. A dual/multiple function of this kind reduces constructional as well as economic expenditure/the number of required components.

Moreover, by configuring the contact element as a spring element, provision may be made at the same time on the one hand for an advantageous fixing force for fixing to the circuit board and/or on the other hand, for fixing to the housing element of the module/light module/interchangeable module.

Furthermore by giving the contact element a dual/multiple function, both an advantageous/economically favorable manufacture of the module/light module/interchangeable module according to the invention is possible. For example, by attaching/mounting the contact element/spring element on the housing or the calotte, not only can the contact element/spring element be assembled, but at the same time the circuit board can also be fixed and electro-conductively connected in an advantageous manner. As a result there is then no need for soldering the contact element to the circuit board for example, which further reduces expenditure/manufacturing cost for a light module/module according to the invention.

Advantageously the module/light module comprises an advantageous contact strip with at least three, preferably six or more contacts and/or first and/or second contact surfaces and/or contact elements/spring elements, which are preferably arranged on the face side. Preferably the contact strip is oriented transversely, in particular essentially vertically to the longitudinal axis and/or arranged in/on the longitudinal center plane and/or oriented essentially linearly. In other words, the contact strip is arranged in particular vertically to the longitudinal axis and in addition essentially centrally. Preferably the contact strip comprises at least six contacts or six second contact surfaces and/or contact elements, so that advantageously up to five light modules (a neutral conductor or a grounding plus five signal conductors) are available for use in a signaling device according to the invention.

Preferably the contact strip is arranged at least in/on a base surface or face side and/or base surface element of the module/light module, wherein a symmetric configuration is preferable. A symmetric configuration permits e.g. a more flexible assembly or connection with an adjacent module/light module or an adjacent circuit board.

With an advantageous variant of the invention a module/light module, on a first face side or base surface, comprises a circuit board contact strip (i.e. as a first contact strip) with at least three, preferably six or more first contact surfaces arranged on the face side of the circuit board (separately or spaced-apart), and, on a second face side or base surface arranged opposite the first face side or base surface, a contact element contact strip (i.e. as a second contact strip)

with at least three, preferably six or more second contact surfaces and/or contact elements or contact springs.

For example, in particular when using a bayonet closure for connecting two detachably connectable adjacent modules/light modules/interchangeable modules, a common contact strip and/or symmetrical design of the second contact surfaces or contact elements is of advantage. The rotatory adjustment path of the bayonet closure and the resulting rotation of the contact surfaces of the inventive contact relative to the longitudinal center plane of the adjacent module/light module generates a first position, wherein the contact strip and the adjacent circuit board/the two longitudinal center planes are arranged at an acute angle in relation to each other and essentially cross each other in the middle. Correspondingly, in a second position or operating position the two adjacent circuit boards are arranged flush with each other or on a common longitudinal center plane. This means that during rotation/relative movement the two shanks of the previously described intersecting X-arrangement of the circuit boards or longitudinal center planes of the two adjacent modules move towards each other and ultimately overlap or until the two X-shanks are arranged in parallel (on top of each other).

A rotation/relative movement of the two circuit boards, in particular of the contact strip and the adjacent circuit board, is thus realized, both from one side and also from the other side.

Advantageously the contact element, in longitudinal axis direction, comprises an exposed arched and/or bent/angled surface. In this way a transverse adjustment or rotational movement between two adjacent modules/light modules/interchangeable modules becomes advantageously realizable. For example this makes it possible, in an advantageous manner, to realize a spring contact/a press-on force between the two contact surfaces according to the invention. Also manufacturing tolerances of the individual contacts/between the contacts can thus be compensated for, for example in the case of a contact strip with a number of contacts.

Preferably at least two or all, or each contact of the contact strip, in particular at least two or all second contact surfaces and/or contact springs/contact elements are adjustable in direction of the longitudinal axis essentially separately/independently of each other. This allows among others assembly and manufacturing tolerances in particular of the contacts or contact elements and/or circuit boards to be compensated for in an advantageous manner, and/or for separate contact forces to be generated.

A common spring element is possibly provided, such as an elastomer element or similar, which in essence is aligned vertically to the longitudinal axis and on which at least two or all second contact surfaces and/or contact elements are arranged. Again, this makes it possible to realize a largely separate/independent adjustment of the at least two or of all second contact surfaces and/or contact elements.

Advantageously the contact element is configured at least as a locking element for connecting with the housing element and/or as a clamping element for clamping onto the circuit board. This will permit an advantageous manufacture/assembly of the module or light module/interchangeable module, since during assembly of the contact element configured as a locking element, it locks into the housing element during assembly and/or forms a clamping connection with the circuit board for example. Therefore, it can be achieved when assembling the contact element, in or on the module or with the module, that the pre-assembled circuit board is reliably fixed or clamped/tensioned in operation with the aid of the contact element. Thus by assembling the contact element, not only the contact element, but also the circuit board is simultaneously fixed in the module or light module/interchangeable module in an advantageous manner. Accordingly additional assembling or working steps during manufacture of a corresponding module/light module according to the invention can be avoided, which has an economically favorable effect.

With a special variant of the invention the contact element comprises at least one locking catch or similar on at least one side respectively, preferably on two sides, in particular on two opposite sides extending in transverse direction to the longitudinal axis and/or in direction of the longitudinal axis, so that the contact element or locking element can be locked into or fixed in an advantageous manner to the housing element or the calotte of the module/light module/interchangeable module. Advantageously a substantially symmetrical configuration of the locking catches or the clamping element is provided at least in this area so that assembly of the contact element or locking element on/with/in the housing element can be flexibly effected inter alia in two positions offset by 180°. This makes assembly of the contact element easier, since there is no need for an assembly person or assembly robot or machine to observe the "one and only correct side" during fitting/assembling of the contact element on/in/to the housing element.

Preferably the circuit board, on two opposite lateral surfaces extending in direction of the longitudinal axis, comprises respectively at least one contact section per contact or per contact element. This again allows flexibility to be realized during assembly of a contact element, which preferably is configured as a clamping element for clamping onto the circuit board. Alternatively or in combination with the above said advantageous measure, any given assembly with two assembly positions offset by 180° of the contact element can be realized, in particular even for a not completely symmetrical configuration of the contact element, at least of the connecting/clamping area of the contact element. For example the contact element may comprise (only) one connection lip or similar (on merely one side) for making contact with the circuit board or the corresponding contact section of the circuit board.

As required, complete symmetry may be realized with two connection lips of the contact element arranged on opposite sides, wherein the circuit board, in the assembled operating state, is arranged or clamped in an advantageous manner between these two connection lips of the contact element. Accordingly these two connection lips can be connected/contacted with the electrically conducting contact sections of the lateral surfaces of the circuit board, which are advantageously provided on both sides.

With a particular further development of the invention the contact element comprises a contact ramp for an adjacent circuit board and/or first contact surface, aligned at an acute angle to the longitudinal axis on one or at least both sides of the longitudinal center plane. As a result, in case of a transverse adjustment relative to the longitudinal axis, both linearly and rotationally about the longitudinal axis, a face-side contact of the circuit board or the first contact surface can be adjusted or moved with the aid of the advantageous ramp relative to the second contact surface of the contact. The contact according to the invention can thus be realized as an advantageous sliding contact, so that a.o. manufacturing and/or assembly tolerances of the components/elements involved can be compensated for.

Preferably, due to the acute-angle alignment of the contact ramp in relation to the second contact surface according to the invention, the second contact surface can also be adjusted in longitudinal direction, so that a.o. an advantageous contact force/tension force can also be generated. This tension force or contact force is preferably oriented in longitudinal direction of the longitudinal axis, so that the two contact surfaces of the contact according to the invention are pushed/pressed against each other. This improves electric contacting/electric transfer and thus operational safety of the contact according to the invention.

In one variant with a contact ramp formed on both sides, i.e. the second contact surface is arranged between two contact ramps, it is possible that, when adjacent modules/light modules or two respective contact surfaces are joined together, these can be adjusted/moved at random/from both sides towards each other. As such, during e.g. a rotational adjustment, when two adjacent modules/light modules, preferably the linear circuit board and/or a linearly oriented contact strip with several contact elements/spring contacts arranged along the longitudinal center plane are assembled, aligning the X-shanks can be realized in an advantageous manner by rotation out of a first X-position of the corresponding contact surfaces about the longitudinal axis or rotary axis. With such a rotation of the two adjacent modules/light modules the circuit board and the contact strip move in particular towards each other from both sides, i.e. each X-shank of the circuit board and the individual contact element is wiped over from "the right" and from "the left" by the respectively other contact surface. Therefore contact ramps on both sides of the second contact surface are a great advantage, when adjacent modules/light modules are joined together.

Preferably when joining two adjacent modules/light modules/interchangeable modules together, an adjustment path is provided in a transverse plane, which is essentially aligned vertically or orthogonally to the longitudinal axis. Such an adjustment path makes it possible to advantageously realize a sliding contact.

With an advantageous variant of the invention, when two adjacent modules/light modules are in the non-assembled operating state, provision is advantageously made for an overlapping or parallel offset of the first contact surface relative to the second contact surface in direction of the longitudinal axis. In this way an advantageous press-on force/contact force can be generated and/or manufacturing tolerances/assembly tolerances can be compensated for.

Advantageously, in order to detachably connect (without tools) the first light module with the adjacent module/light module, at least one adjustment path of the light module and/or the module includes at least partially a rotation path about the longitudinal axis, and/or at least one bayonet closure is provided for detachably connecting (without tools) the first light module with the adjacently arranged module. By these means it is achieved that for example due to a first adjustment path oriented in direction of the longitudinal axis, two adjacent modules/light modules/interchangeable modules are joined, and the original parallel offset of the two contact surfaces in longitudinal axis direction of the two contact surfaces is overcome/eliminated/compensated for and with a subsequent rotational adjustment path or a rotation, fixing or locking or clamping is realized. On the one hand, this leads to safe or reliable contacting and fixing of two adjacent modules/light modules/interchangeable modules in operation. On the other hand, replacing or exchanging a module/light module/interchangeable module is thereby made possible without a great deal of expenditure.

All of the aforesaid is of great advantage in case of damage or impairment of electronic components or similar of a module/light module. Also expansion or modification of the optical signaling device or signal pillar can thus be realized without a great deal of expense. For example a further module in a color not used up to now can be subsequently added, or a light module in a certain color no longer required if conditions change, can be removed without a great deal of effort.

A contact according to the invention, in particular a sliding contact with the two contact surfaces of the contact, which are preferably oriented vertically or orthogonally to the longitudinal axis, may be subjected to a certain amount of wear/abrasion on the contacts/contact surfaces in the event of multiple assembling and disassembling operations without this having disadvantages in respect of contacting/the contact according to the invention. As such, due to the parallel offset and/or the advantageous resilient design in particular of the second contact surface/the contact element, it is possible to compensate for a respective abrasion of the contact surfaces.

Preferably the base module and/or the holding module comprises at least one circuit board/one connecting circuit board for electrically connecting the signal generator and/or at least one contact element and/or a contact strip. In an advantageous manner the contacting of the base module and/or the holding module is configured identically and/or, with respect to its construction, almost identically or similar to the contacting of the first light module and/or module. In this way advantageous modularity of the optical signaling device according to the invention can be realized. Similarly also the base module/the holding module can be advantageously connected/electrically contacted to a light module according to the invention.

EXEMPLARY EMBODIMENT

Figure 2:
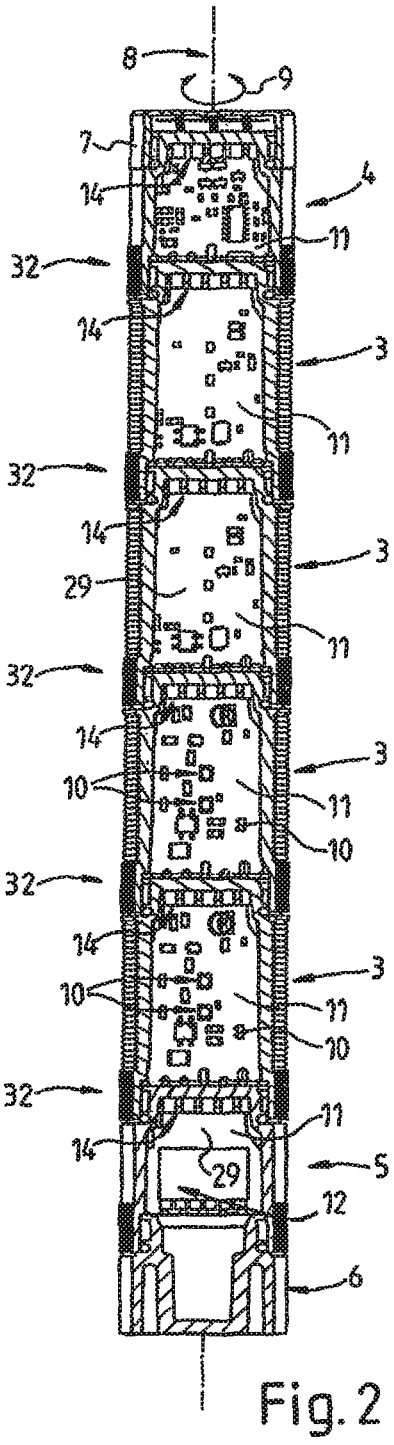
Figure 3:
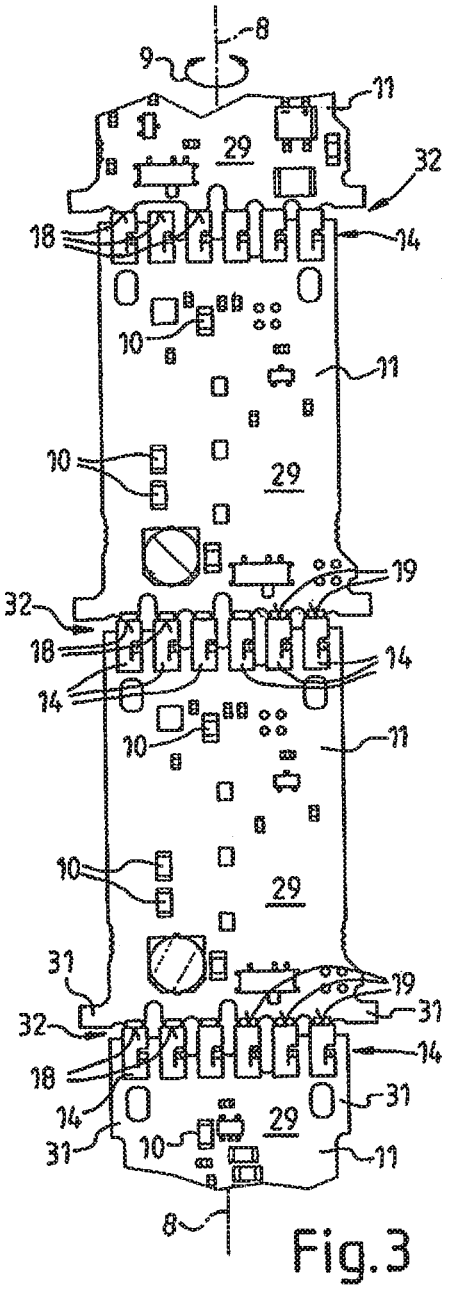
Figure 4:
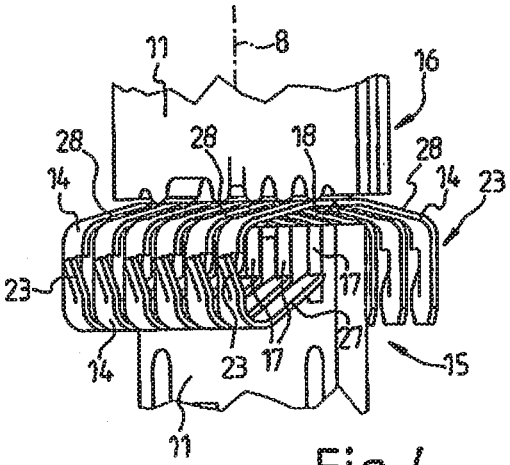
Figure 5:
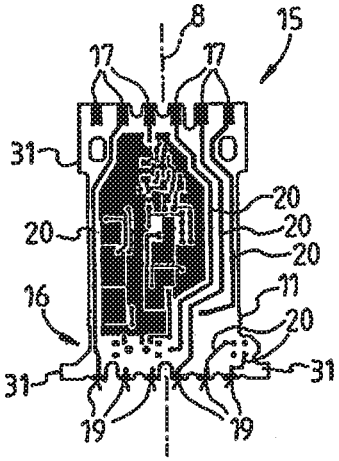
Figure 7:
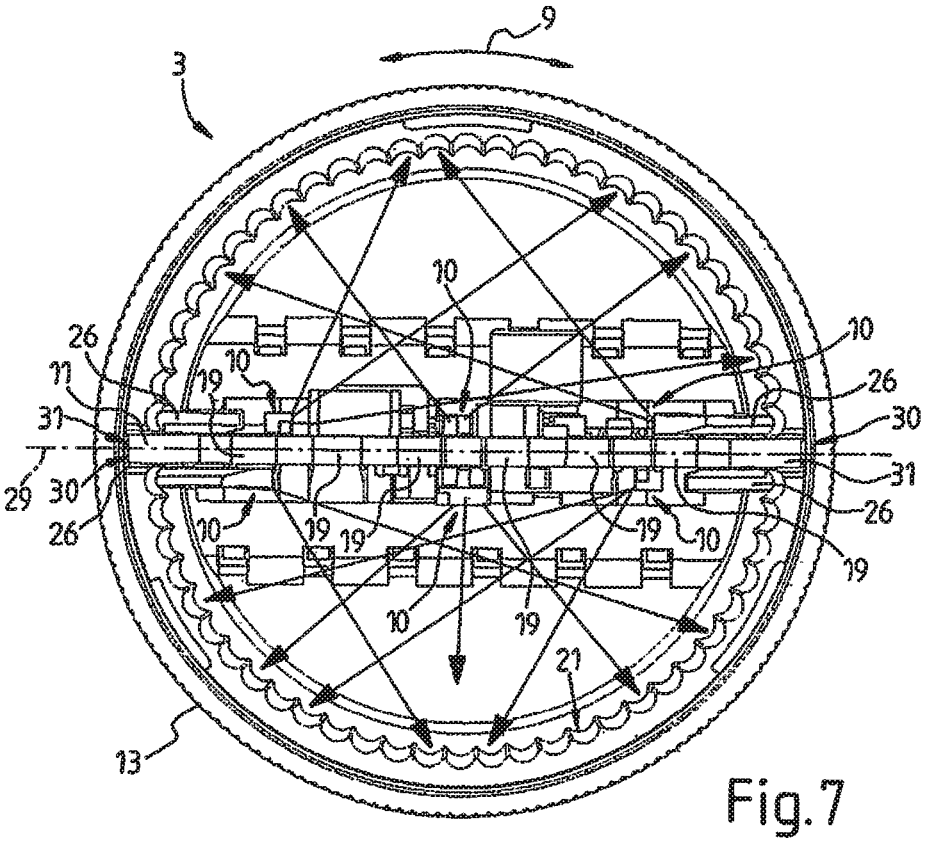
Figure 6:
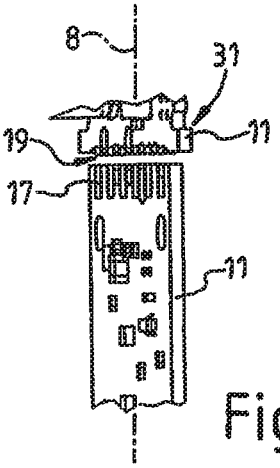
Figure 8:
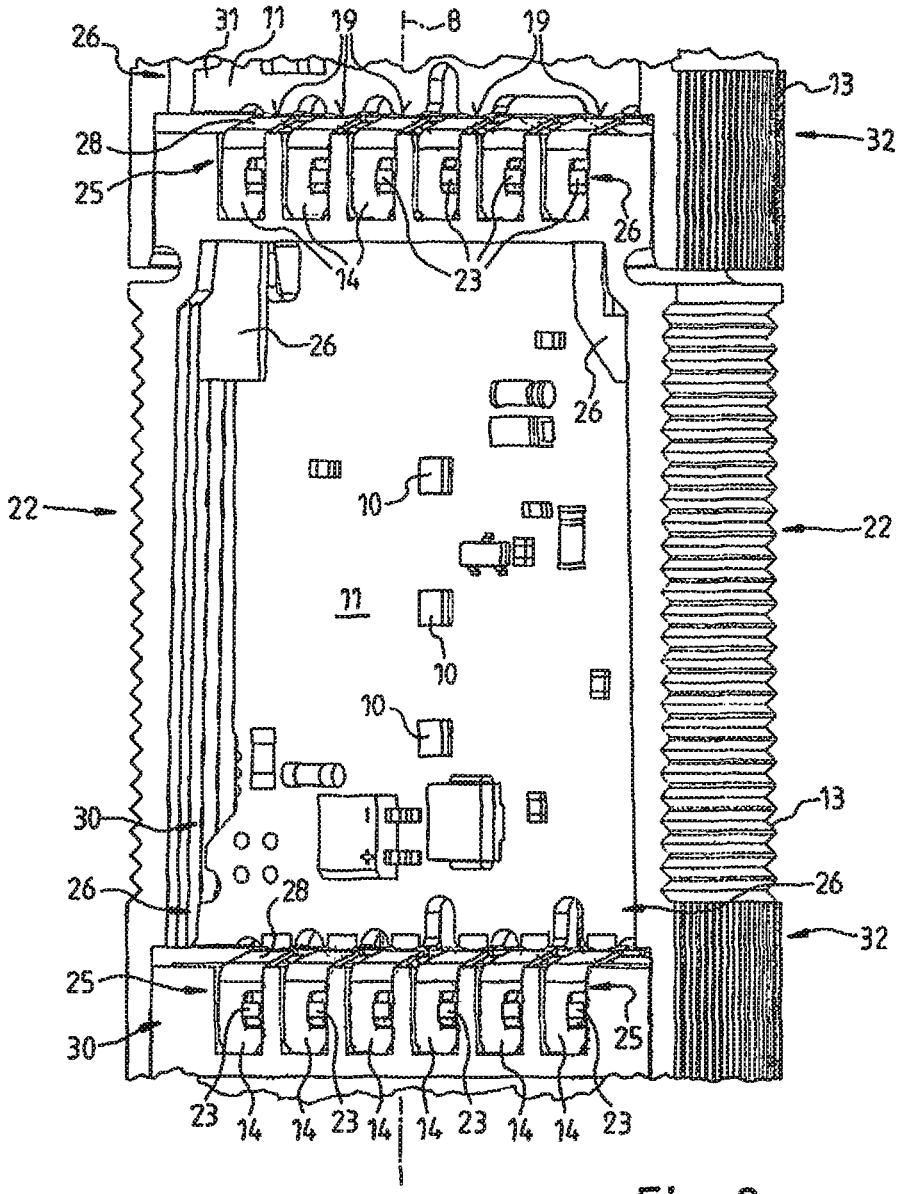
Figure 10:
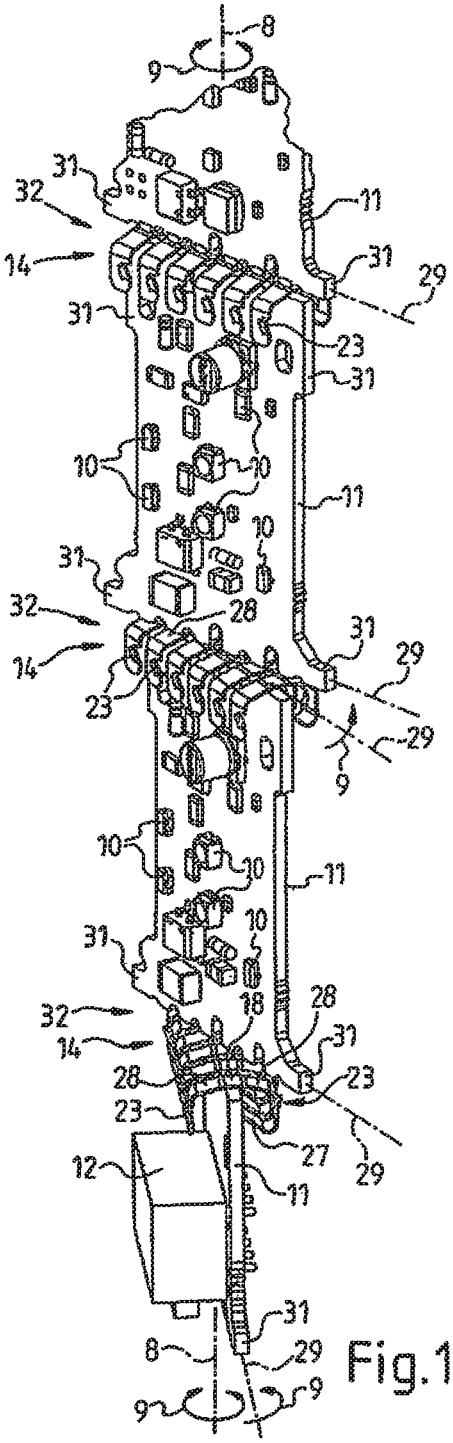
Figure 9:
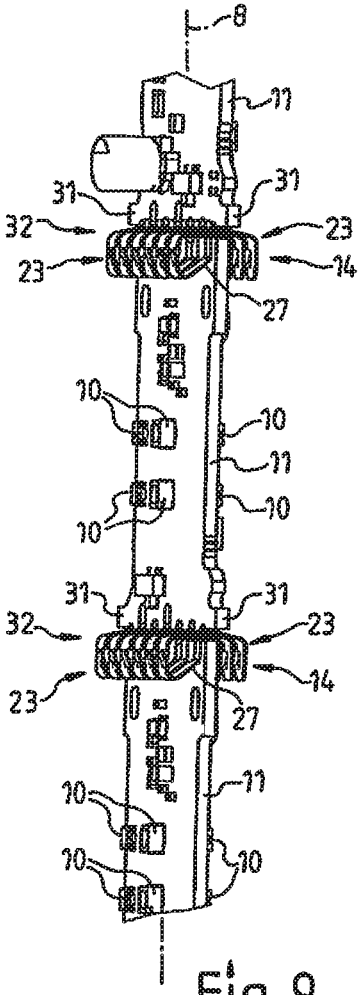
Figure 11:
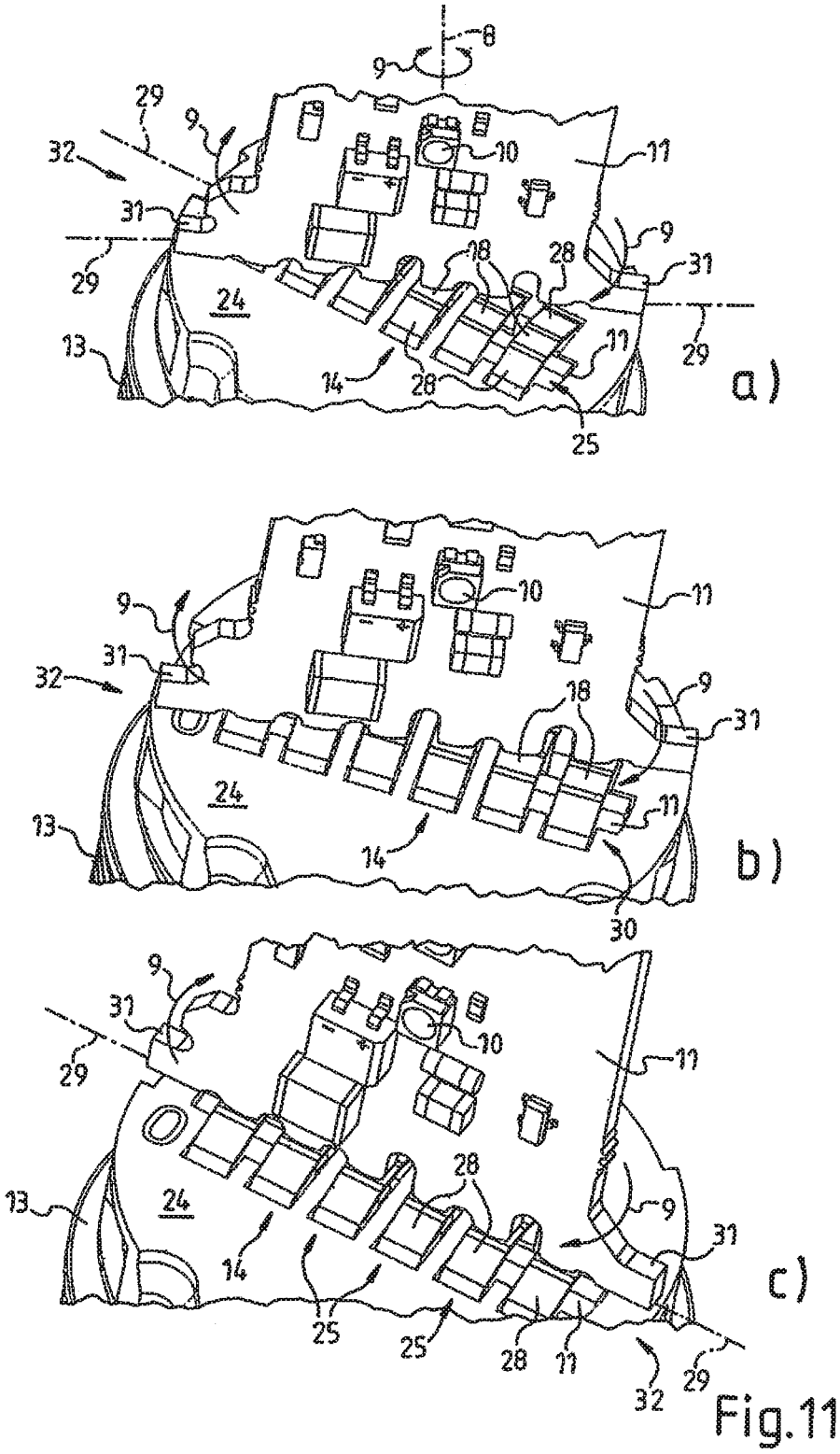

A preferred exemplary embodiment of the invention is depicted in the drawing and will now be explained in greater detail with reference to the figures. In the drawing:

FIG. 1 schematically shows a signal pillar according to the invention,

FIG. 2 shows the signal pillar according to FIG. 1 in section,

FIG. 3 shows a schematic arrangement of freed circuit boards of various modules of the signal pillar as per FIG. 1, FIG. 4 shows a schematic, perspective, enlarged detailed view of a contacting of two adjacent circuit boards, FIG. 5 shows a schematic view of a circuit board, FIG. 6 schematically shows a perspective view of two adjacent circuit boards without an in-between contact element, FIG. 7 shows a schematic top view of a module of a signal pillar as per FIG. 1, FIG. 8 shows a schematic, perspective sectional view of a detail of the signal pillar as per FIG. 1, FIG. 9 shows schematic exposed circuit boards in a perspective view, FIG. 10 schematically shows, in a perspective view, the positioning of adjacent circuit boards in various positioning steps with freed circuit boards and contact elements and FIG. 11 schematically shows, in an enlarged detailed perspective view, various assembly positions of two adjacent modules.

FIG. 1 schematically shows a signal pillar 1 according to the invention attached to a technical device 2, wherein the signal pillar 1, via connecting lines not shown in detail, has electrical signals transmitted to it from the machine/the device 2/a respective electrical/electronic control, which contain information relating to operating states of the device 2.

FIG. 1 shows that the signal pillar 1 is of modular construction, wherein in the exemplary embodiment shown the signal pillar 1 comprises a total of four light modules 3 with illuminants as well as additionally at the (upper) end, an acoustic module 4 for generating acoustic signals and at the end a terminating lid 7. The signal pillar 1/the light modules 3 are connected with a base module 6 via a connecting module 5, wherein the base module 6 is configured for fixing the signal pillar 1 on the technical device 2, e.g. via a screw connection or similar.

As is already common practice with signal pillars 1, individual modules 3, 4, 5, 6, 7 are detachably connectably connected with each other without tools in a known manner via bayonet closures not shown in detail. This means that individual modules 3, 4, 5, 6, 7 can be assembled/affixed and again disassembled/detached via an adjustment path in direction of a longitudinal axis 8 in combination with a rotation 9 about the longitudinal axis 8. Modules 3, 4, 5, 6, 7 of this kind are usually called "interchangeable modules", since they can be manually quickly replaced/assembled and disassembled without a great deal of effort, i.e. without the use of tools. This is of particular advantage, in particular when the number of light modules 3/acoustic modules 4 or their colors need to be amended or modified, and also when one of the electronic) modules 3, 4, 5 has been damaged or is faulty. For example a damaged module 3, 4, 5 can be replaced or exchanged without a great deal of expense by a new one configured in an analog manner.

FIG. 2 shows the signal pillar 1 as per FIG. 1 in cut-open section. This shows circuit boards 11 or so-called printed circuit boards 11 of the light modules 3, acoustic module 4 and connecting module 5. The connecting module 5 comprises a circuit board 11, to which a connecting terminal 12 is attached or arranged. Electrical lines not shown in detail, which come from the device 2 and which pass through the base module 6, are connected/attached with the aid of this connecting terminal 12.

FIG. 2 also makes it clear that the circuit boards 11 of the light modules 3 comprise advantageous illuminants 10, preferably LEDs 10. By contrast the acoustic module 4 comprises a circuit board 11, which comprises an acoustic element not shown in detail, in particular a piezo buzzer or similar, so that acoustic signaling can be realized. Moreover the circuit boards 11, depending on the application, may comprise various electrical/electronic components such as transistors, resistances, capacitors, microprocessors etc. in various numbers and with different characteristics or wiring.

FIG. 2 also reveals that the circuit boards 11 or printed circuit boards 11, when in assembled operating position, are arranged essentially flush in direction of the longitudinal axis 8 one behind the other in/on a longitudinal center plane 29 of the signal pillar 1. The longitudinal center plane 29 in FIG. 2 corresponds to the viewing plane/leaf plane or lies parallel to the leaf plane. The detailed views shown in FIG. 3 or 4 and in FIGS. 8 to 11 also reveal that in the assembled operating position, contact elements 14 or contact springs 14 or leaf spring contacts 14 are provided between the circuit boards 11 aligned flush in longitudinal direction 8 for electrical contacting.

In particular in FIGS. 3 and 4 it is obvious for example that the contacting between the circuit boards 11 is effected with the aid of contact springs 14 such that the circuit boards 11 comprise lateral contact surfaces 17 at a first "upper" end 15, in particular with respect to the construction of the signal pillar 1, which for example are configured as soldered contacts. These contact surfaces 17 are preferably arranged on a lateral surface/plane or on the two opposite lateral surfaces of the circuit board 11. The lateral surfaces or contact surfaces 17 are advantageously aligned in longitudinal direction 8 and/or arranged parallel to the longitudinal center plane 29. In operation the respective circuit board 11 is permanently connected via these lateral surfaces or contact surfaces 17 in each case with a separate contact element 14 or a separate contact spring 14. The contact spring 14, for contacting an adjacent circuit board 11, comprises a contact surface 18, i.e. a so-called second contact surface 18 in terms of the invention. This contact surface 18 can be seen more clearly in particular in FIGS. 10 and 11.

One contact 32 according to the invention between two circuit boards 11 arranged in longitudinal direction 8 of two adjacent modules 3, 4, 5, 6 is realized as a detachable contact 32 comprising the so-called second contact surface 18 and a so-called first contact surface 19. In the exemplary example shown the contact surface 19 of the circuit board 11 is configured as a face side 19 or first contact surface 19. In this way the contact surface 19 can be advantageously realized as a solder joint or similar, which is arranged or attached to the face side.

FIG. 5 shows a circuit board 11 according to the invention, wherein a.o. the face sides 19 or first contact surfaces 19 are shown in more detail. Moreover connecting lines 20 between the first face-side contact surfaces 19 and the lateral contact surfaces 17 at the opposite end 15 of the circuit board 11 are shown. The schematic top view of a circuit board 11 according to the invention in particular makes it clear that an electrically conducting connection of the (first) contact surfaces 19 is realized starting from a first end 16 of the circuit board 11 via lines 20 of the circuit board 11 up to the (lateral) contact surfaces 17 at the opposite second end 15 of the circuit board 11. This means that the circuit board 11 or printed circuit board 11 is configured as a connecting line between adjacent modules 3, 4, 5. There is thus no longer any need for separate electric wires commonly used in the art up to now for connecting adjacent modules 3, 4, 5 or for a so-called "loop-through" of the electric energy/power supply, when using such an advantageously configured circuit board 11. The arrangement of the circuit board 11 in longitudinal direction 8/on/in the longitudinal center plane 29 is therefore of great advantage, wherein advantageously, aligned flush between the two adjacent circuit boards 11, the contact surfaces 18 and 19 of the detachably connectable contact 32 are arranged between two adjacent modules 3, 4, 5.

As such FIG. 9 for example in particular makes it clear, with the planar/flat circuit boards 11 and the contact springs 14 being freed from other components such as the calotte 13 of the signal pillar 1, that in assembled operating position a flush arrangement of preferably all circuit boards 11 in longitudinal direction 8 or on/in the longitudinal center plane 29 is provided/realized, wherein the contact according to the invention/the contact surfaces 18 and 19 according to the invention are arranged/realized between the face sides of the circuit boards 11 exposed/oriented in longitudinal direction 8. This makes it possible to realize a.o. an advantageous flow of force from/in longitudinal direction 8 or within the longitudinal center plane 29 or the circuit board plane. This means that no torques whatsoever are being generated upon laterally offset components or eccentrically arranged contact surfaces as is the case in the state of the art. Therefore comparatively small dimensions can be advantageously realized for a firm fixing or attachment of the circuit boards 11 and/or for the contact elements 14.

Further, in assembled operating position, due to the flush arrangement of the circuit boards 11 with contact elements 14 or contact surfaces 18, 19 lying/arranged in between, it is possible to realize an advantageous relatively large press-on force with the aid of the preferably metallic spring contacts 14. Thus a comparatively large contact force/press-on force can be generated without a massive configuration of holding and/or fixing elements 26, 30, 31 being necessary. Moreover assembly or manufacturing tolerances can thus be advantageously compensated for. High-quality contacting and high-quality safe electric contacting/transfer between adjacent modules/light modules/interchangeable modules 3, 4, 5, 6, 7 is ensured with the aid of the contact system according to the invention.

Moreover FIGS. 7, 9 and 10 above all make it clear that illuminants 10/LEDs 10 are arranged on both lateral surfaces/longitudinal planes of the circuit board 11 of a light module 3. In FIG. 7 the radiation directions are indicated by schematic individual radiation arrows. It can be seen that on the one hand so-called "top LEDs" 10 are arranged in the center area of the circuit board 11/in the center of the light module 3/the calotte 13, which radiate light away from the circuit board 11 radially outwards in a relatively large angular area. Outside/in the edge areas of the circuit board 11 so-called "side LEDs" 10 are arranged, which radiate light partly parallel and partly at an acute angle to the circuit board 11 (see schematic light arrows). To summarize, FIG. 7 makes it clear that a practically uniform all-round illumination of the entire calotte 13 of the light module 3 is realized due to the advantageous arrangement of the illuminants 10/respective "side LEDs" and "top LEDs".

Moreover FIG. 7 makes it clear that the calotte 13 comprises an advantageous inner riffling 21 on its interior. The inner riffling is preferably formed as a circular or semi-circular inner riffling 21. In combination with an outer riffling 22 this can be used to realize a.o. an advantageous light diffusion. The outer riffling 22 shown in FIG. 8 is preferably jagged or triangular-shaped.

Advantageously an inner riffling 21 oriented in longitudinal direction 8, in particular an inner riffling 21 semi-circular in cross-section is provided, which can be advantageously created using an injection molding process or respectively advantageous injection molding tools. In an analogous manner an outer riffling 22, in particular a jagged or triangular-shaped outer riffling 22, can be created transversely to the longitudinal axis 8/vertically or orthogonally to the longitudinal axis 8, again with the aid of an advantageous injection molding technique/e.g. with the aid of two semi-shell injection molding elements.

As such the face-side base surface 24 can for example be configured in one piece with the hollow-cylindrical calotte 13, in particular can be manufactured by injection molding from a plastic material. However, a module 3, 4, 5 can also be used which comprises a (hollow-cylindrical) calotte 13 manufactured in particular from transparent or semi-transparent and/or milky plastic material, with a separate base surface 24 or face side of light-impermeable material and/or with a light-impermeable layer or coating. Generally, when using a light-impermeable base surface 24, it is achieved advantageously that light, in particular colored light, from a module 3, 4, 5 cannot penetrate into a respectively adjacent module 3, 4, 5, 7 and partly illuminate it. This will improve the light pattern of a signal pillar 1.

Preferably a one-piece unit consisting of a face-side base surface 24 with hollow-cylindrical calotte 13 made of at least transparent/light-permeable material is provided, wherein a light-impermeable layer or coating is applied to the face-side base surface 24. This light-impermeable layer or coating of the base surface 24 is preferably configured as a sticker with advantageous information/details e.g. about the product, the manufacturer, the applicability or technical properties/qualities or test certificates of the module 3, 4, 5, 6, 7.

FIG. 6 shows two adjacent circuit boards 11 in the assembled state, but without the contact springs 14 to be arranged in between, when in operation. This highlights in particular the arrangement of the contact surfaces 17 and face-side contact surfaces 19 of the respective adjacent circuit boards 11 of the respectively adjacent modules 3, 4, 5 or light modules 3.

FIG. 4 shows an advantageous configuration of the contact springs 14. The contact springs 14 are preferably manufactured from metal, in particular springy elastic metal. Preferably locking catches 23 are provided, arranged at least one one, in particular on two opposite sides and essentially oriented in longitudinal direction 8, which in an advantageous manner, when assembled, are in operative connection with recesses 25 or locking catches not shown in detail of the calotte 13 or a face-side base surface 24 of the light module 3 or acoustic module 4 or connecting module 5 and which ensure a permanent reliable or firm locking/fixing.

Due to the spring contacts 14 being fixed to the base surface 24 in recesses 25 with the aid of locking catches 23, an advantageous assembly of the module 3, 4, 5 can be realized for example. For example a circuit board 11/a holding web 31 of the circuit board 11 is retained with the aid of holders 26 and/or a guide groove or retaining groove 30 of the calotte 13. To this end the circuit board 11 is inserted into the module 3, 4, 5 in direction of the longitudinal axis 8, so that a radially defined arrangement or a retaining of the circuit board 11 is realized by the calotte 13, at least at a first end 16. A firm fixing of the circuit board 11 (at the end 15), in particular in longitudinal direction 8, is achieved by the advantageous assembly of the spring contacts 14 in the recesses 25 of the base surface 24. The spring contacts 14 or contact springs 14 are firmly locked or fixed to the base surface 24 or calotte 13 with the aid of the locking catches 23. At the same time due to the advantageous shaping of the contact springs 14, in particular with contact lips 27 oriented at an acute angle to the longitudinal axis 8, a pushing force is generated on the one hand in longitudinal direction 8 and on the other hand, a clamping force or press-on force is generated transversely to the longitudinal axis 8 relative to the circuit board 11, so that the circuit board 11 is arranged/pressed against the calotte 13 or base surface 24 on a stop of the base surface 24 on the one hand and on the other, is clamped or pressed-on transversely to the longitudinal axis 8 and is thus securely fixed at the end 15.

In addition due to the contact lip 27 a secure contacting of the circuit board 11 or the contact surface 17 with the contact spring 14 is realized. As such a force-lock or operative connection is generated between the respective circuit board 11 and the housing or the calotte 13 of the respective module 3, 4, 5 between the one or more locking catches 23 or the one or more sides of the contact spring 14 oriented in longitudinal direction 8 and the contact lip 27.

Due to an advantageous symmetrical configuration of the recess 25 and/or the sides of the contact spring 14 oriented in longitudinal direction 8 it can be achieved that the contact springs 14 can be pushed or locked into the respective recess 25 in a random manner, i.e. in particular in two different positions/mounting positions offset by 180°, without this being connected with a disadvantageous fixing or contacting. As such the circuit board 11, respectively on both opposite longitudinal sides/planes advantageously comprises respectively advantageous contact surfaces 17 for contacting with the contact springs 14. Therefore there is no need for a person or robot or assembly machine, during manufacture of the module 3, 4, 5 to pay particular attention to the correct mounting position of the contact springs 14, since there are two correct or equivalent mounting positions, which constitutes a distinct simplification/improvement of manufacturing expenditure.

The figures also reveal that the two contact surfaces 18, 19, which make up the inventive detachable contact 32 between the modules 3, 4, 5 or the face sides of the circuit boards 11, are oriented essentially vertically or orthogonally to the longitudinal axis 8. Particularly FIGS. 4, 10 and 11 additionally show that the contact springs 14 each comprise two ramps 28 arranged at an acute angle to the second contact surface 18. These ramps 28 advantageously permit that e.g. in case of a bayonet closure between adjacent modules 3, 4, 5, 6, 7, due to the transverse adjustment or rotational movement in direction 9 (relative movement between two adjacent modules 3, 4, 5, 6, 7), a circuit board 11/the first contact surfaces 19 arranged/existing on the face side are advantageously adjustable along the ramps 28 up to the second contact surface 18 of the spring contact 14.

The contact springs 14, in a contactless state, are preferably arranged such that during contacting or during lateral or rotational adjustment of adjacent modules 3, 4, 5, 6, 7 the contact springs 14 advantageously (with the aid of the ramps 28) realize a certain spring travel in direction of the longitudinal axis 8. This has the effect of, on the one hand, generating an advantageous spring force or contact force in longitudinal direction 8 thereby ensuring a secure electric contacting, and on the other hand, being able to compensate for assembly and/or manufacturing tolerances, for example of the face-side contacts or soldered contacts of a circuit board 11. In this way it is reliably ensured that all contact springs 14 of a first module 3, 4, 5, 6, 7 (respectively separately/independently of each other) together with the first contact surfaces 19 (preferably of one face side of a circuit board 11) of a second module 3, 4, 5, 6, 7 reliably generate an electric contact 32 according to the invention.

The exemplary contacting process/the rotational/relative movement between adjacent modules 4, 5, 6, 7, e.g. circuit boards 11 and spring contacts 14 in this case, is illustrated in particular in FIGS. 10 and 11. FIG. 11*a* for example shows a first joining position or mounting position, wherein a first circuit board 11 of a first module 3 (shown in the "upper" part of FIG. 11*a*, without the calotte 13) is arranged at an acute angle to a contact strip with a row of contact elements 14/an adjacent second circuit board 11 of a second module 3, 4, 5, 6. According to FIG. 11*b*, in an intermediate assembly step or second joining position, the first (upper) circuit board 11 is oriented/shown at a smaller angle to the second (lower) circuit board 11 and finally, in FIG. 11*c* the two circuit boards 11 are arranged in operating position essentially parallel/flush with each other/on the longitudinal center plane 29.

Correspondingly different intermediate stages as well as the assembled end position of a contacting system according to the invention/a signal pillar 1 according to the invention are also shown in FIG. 10, wherein the circuit boards 11/the contact springs 14, shown without respective calottes, are exposed, in order to better illustrate the different joining positions. As such the end position/assembled operating position between adjacent modules 3, 4, 5, 6 or adjacent circuit boards 11 with the contact springs 14 is shown in the upper area of FIG. 10, and an intermediate position directly after axially joining/adjusting two adjacent modules 3, 4, 5, 6, in particular the connecting module with the connecting terminal 12 and an adjacent light module 3 is shown in the lower area of FIG. 10. This lower view thus shows the intermediate position in case of a bayonet closure, wherein in a first joining step a relative adjustment of two adjacent modules 3, 4, 5, 6, 7 is effected in longitudinal direction 8 followed by a transverse adjustment or rotation 9 about the longitudinal axis 8, as depicted in the center area of FIG. 10 as intermediate position. This rotation 9 preferably continues up to the end position according to the upper view in FIG. 10 or according to FIG. 11*c* or FIG. 9, wherein the two circuit boards 11, in operating position, are arranged essentially parallel or flush with each other/on the longitudinal center plane 29.

FIG. 7 above all makes it clear that the circuit board 11 is arranged/positioned/fixed in the so-called "longitudinal center plane" 29 of a module 3 or a calotte 13. This longitudinal center plane 29 extends along the longitudinal axis 8 across an entire signal pillar 1, wherein essentially all circuit boards 11 are arranged flush in the longitudinal center plane 29. The inventive contact surfaces 18, 19 of the contact according to the invention are arranged between the circuit boards 11. This generates a continuous flow of force between the individual modules 3, 4, 5, 6, 7 or circuit boards 11 and contact springs 14, without having disadvantageous torques acting upon the contacting/the circuit boards 11.

In this way an advantageous contact strip is realized due to the arrangement of all contact springs 14 along the longitudinal center plane 29/orthogonally to the longitudinal axis 8. This contact strip is advantageously configured symmetrically, which for example is of advantage when using a bayonet closure not shown in detail for the toolless detachable connection of adjacent modules 3, 4, 5, 6, 7 (see a.o. FIGS. 10 and 11).

Principally it is of advantage that the contacting according to the invention of adjacent modules 3, 4, 5, 6, 7 is effected not only by adjusting adjacent modules 3, 4, 5, 6, 7 in longitudinal direction 8 but also, in that alternatively or in combination therewith an adjustment transversely to the longitudinal axis 8 is also present. With the exemplary embodiment shown, in particular with a bayonet closure not shown in detail, rotation 9 about the longitudinal axis 8 is provided for. Due to this rotation 9 or transverse adjustment a sliding contacting or a realization of the contact 32 according to the invention with the two contact surfaces 18, 19 is realized as a sliding contact. This will ensure, on the one hand, a comparatively large-scale contacting, meeting the stringent requirements with regard to electrical contacting or current conduction. Accordingly the contact surfaces 18, 19 are oriented transversely or orthogonally to the longitudinal axis 8 in an advantageous manner.

On the other hand, this contacting according to the invention will not only meet the stringent requirements regarding electrical energy supply or power supply between adjacent modules, but there is also no need now, when using the contacting system according to the invention, for separate electric connecting wires or connecting lines, for example on the inside of the calotte 13 in order to realize a "loop-through" of the energy or power supply.

Furthermore using this contacting or the sliding contact according to the invention, a long service life can be ensured because wear and tear etc. of the contact 32/the contact surfaces 18, 19 can be automatically/elastically compensated for.

Moreover, with the aid of the base surface 24 according to the invention/the contact springs 14, which together are preferably configured as a contact strip, it is possible to achieve not only an advantageous contacting of adjacent modules 3, 4, 5, 6, but also the contacting system/the modules 3, 4, 5, 6, 7 can be configured advantageously in an aesthetic manner.

Moreover, using such an advantageous areal contacting which preferably is arranged/is present essentially transversely or orthogonally to the longitudinal axis on the base surface 24, an advantageous uniform and/or closed base surface 24 can be realized. Thus high demands regarding the protective category/resistance against humidity of the modules 3, 4, 5, 6 or the base surface 24 can be met without a great deal of expenditure. To this end advantageous sealing elements or elastomer seals on the spring contacts 14/in the recesses 25 may be provided for this purpose, which are not shown in any detail. Moreover sealing may also be provided between the modules 3, 4, 5, 6, 7, wherein the calottes 13, in the area of the base surface 24, are provided with externally arranged O-rings or similar. This is of great advantage, in particular in applications with humid air or in humid spaces or similar.

LIST OF REFERENCE SYMBOLS

1 signal pillar
2 device
3 light module
4 acoustic module
5 connecting module
6 base module
7 lid
8 longitudinal axis
9 rotation
10 LED
11 circuit board
12 connecting terminal
13 calotte
14 contact spring
15 end
16 end
17 surface
18 contact surface
19 contact surface
20 line
21 inner riffle
22 outer riffle
23 catch
24 base surface
25 recess
26 holder
27 contact lip
28 ramp
29 longitudinal center plane
30 retaining groove
31 holding web
32 contact

What is claimed is:

1. In a modular signal device having at least one first exchangeable light module with at least one light element to indicate one or more different operating states of a technical device, the first exchangeable light module having at least one first circuit board oriented essentially in direction of a longitudinal axis of the modular signal device with the at least one light element and electrical components, the first circuit board having a first face side oriented in the direction of the longitudinal axis as well as a second face side disposed opposite the first face side and oriented in the direction of the longitudinal axis and an adjacent module having a second light module and/or an acoustic or a holding module and/or a base module for holding and connecting the first exchangeable light module in an operating position, the adjacent module having at least one second circuit board oriented essentially in the direction of the longitudinal axis wherein the improvement comprises an electrical and mechanical curved spring side face contact connection between a first detachable electrical side face contact surface of the first circuit board in a substantially transverse plane to the longitudinal axis of the first circuit board and a second detachable electrical side face contact surface of a second circuit on the second circuit board in the direction of the longitudinal axis on the adjacent module so that the first exchangeable light module is electrically and mechanically connected to the adjacent module by the curved spring side face contact connection between the first circuit board and the second circuit board in the direction of the longitudinal axis and the substantially transverse plane.

2. The modular signal device according to claim 1 wherein the second circuit board has a first face side oriented in direction of the longitudinal axis as well as a second face side disposed opposite the first face side and oriented in the direction of the longitudinal axis and wherein the first and/or second face side of the second circuit board has the second detachable electrical side face contact surface.

3. The modular signal device according to claim 1 wherein the first detachable electrical side face contact surface on the first circuit board and the second detachable electrical side face contact surface on the second circuit board are at least three contact surfaces.

4. The modular signal device according to claim 1 wherein the first detachable electrical side face contact surface on the first circuit board and/or the second detachable electrical side face contact surface of the second circuit board have at least one additional contact surface.

5. The modular signal device according to claim 4 further comprising a housing element for the adjacent module and/or the first exchangeable light module.

6. The modular signal device according to claim 1 wherein the electrical and mechanical curved spring side face contact connection is an arcuate shaped contact spring.

7. The modular signal device according to claim 1 or 6 wherein the electrical and mechanical curved spring side face contact connection is adjustable in direction of the longitudinal axis.

* * * * *